US008926209B1

(12) United States Patent
Wilcox

(10) Patent No.: US 8,926,209 B1
(45) Date of Patent: Jan. 6, 2015

(54) TOOTHBRUSH HAVING INTEGRAL DENTIFRICE DISPENSER

(76) Inventor: Allen Wilcox, Palmer, AK (US)

( * ) Notice: Subject to any disclaimer, the term of this patent is extended or adjusted under 35 U.S.C. 154(b) by 350 days.

(21) Appl. No.: 13/385,251

(22) Filed: Feb. 9, 2012

(51) Int. Cl.
*B43K 5/06* (2006.01)

(52) U.S. Cl.
USPC ..... 401/175; 401/171

(58) Field of Classification Search
USPC ..... 401/175, 150, 171, 172; 222/390
See application file for complete search history.

(56) References Cited

U.S. PATENT DOCUMENTS

| | | | | | |
|---|---|---|---|---|---|
| 1,923,974 | A | * | 8/1933 | Hand | 222/390 |
| 3,141,465 | A | * | 7/1964 | Petropoulos | 401/175 |
| 3,409,381 | A | * | 11/1968 | Hoffman | 401/175 |
| 3,802,023 | A | * | 4/1974 | Spatz | 401/175 |
| 4,135,831 | A | * | 1/1979 | Reitknecht | 401/175 |
| 4,277,194 | A | * | 7/1981 | Smith | 222/390 |
| 4,421,433 | A | * | 12/1983 | Villanueva | 401/175 |
| 4,863,072 | A | * | 9/1989 | Perler | 222/390 |
| 4,865,480 | A | * | 9/1989 | Reynolds et al. | 401/175 |
| 4,957,125 | A | * | 9/1990 | Yaneza | 401/175 |
| 5,066,155 | A | * | 11/1991 | English et al. | 401/175 |
| 5,584,359 | A | * | 12/1996 | Reinersman | 222/390 |
| 5,727,891 | A | * | 3/1998 | Lang | 401/175 |
| 5,879,095 | A | * | 3/1999 | Gueret | 401/172 |
| 5,927,889 | A | * | 7/1999 | La Flower | 401/175 |
| 6,213,662 | B1 | * | 4/2001 | Aljanedi | 401/175 |
| 6,234,698 | B1 | * | 5/2001 | De Laforcade | 401/175 |
| 7,367,737 | B2 | * | 5/2008 | Johns | 401/171 |
| 7,717,304 | B2 | * | 5/2010 | Patey et al. | 222/390 |
| 2002/0090250 | A1 | * | 7/2002 | Blecher | 401/175 |
| 2006/0088362 | A1 | * | 4/2006 | Chase et al. | 401/172 |

* cited by examiner

*Primary Examiner* — David Walczak
*Assistant Examiner* — Bradley Oliver
(74) *Attorney, Agent, or Firm* — Michael J. Tavella

(57) ABSTRACT

A brush head and a cylinder filled with dentifrice, within the chamber. A dial is rotated, relative to the cylinder, a piston is enabled to push dentifrice through to the brush head channel. Dentifrice is then forced between a series of arranged bristles, seated in angular degree, around the exiting bore. These bristle expand toward a vertical position, acting as a guide to direct the moving dentifrice atop of the remaining brush head bristles. The cylinder can be refilled.

10 Claims, 14 Drawing Sheets

FIG. 6.
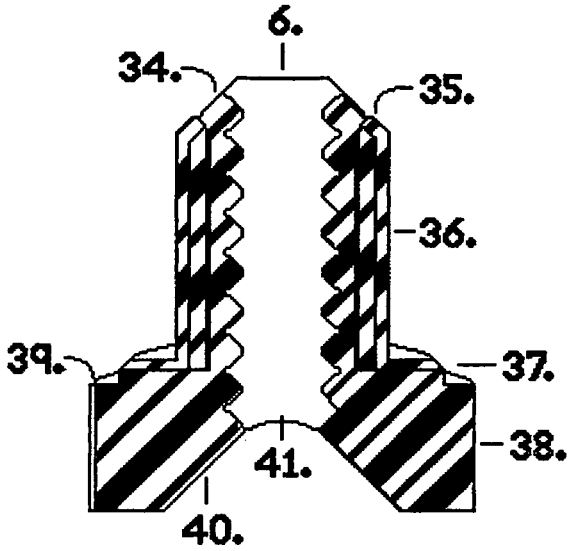
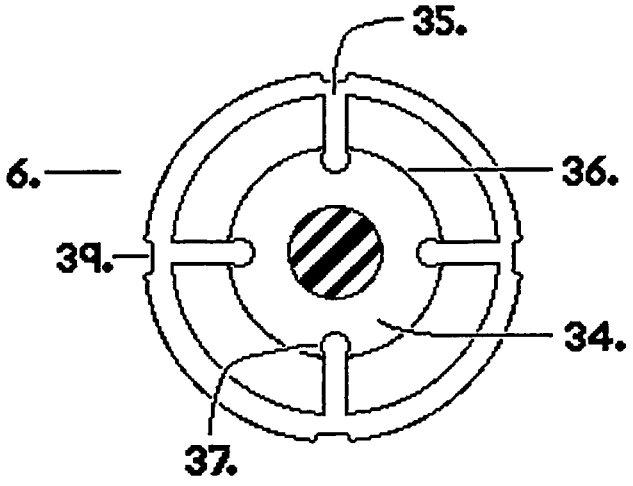
FIG. 6B.

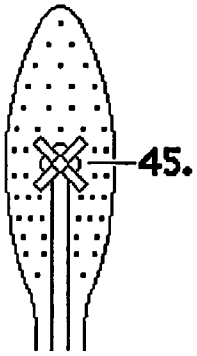
FIG.10. A.
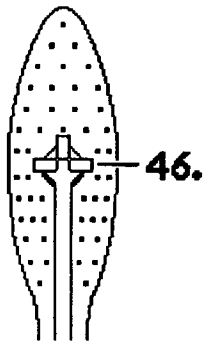
FIG.10. B.
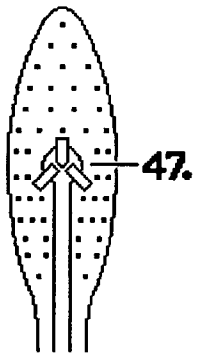
FIG.10. C.
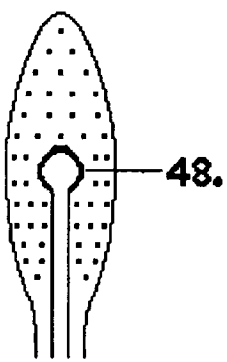
FIG.10. D.
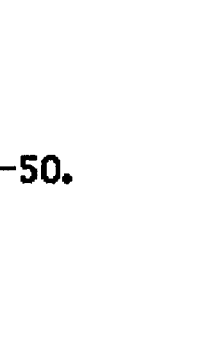
FIG.10. E.
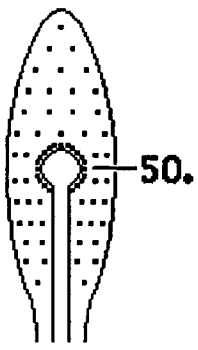
FIG.10.F.
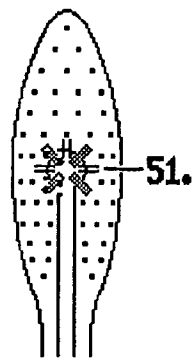
FIG.10. G.

TOOTHBRUSH HAVING INTEGRAL DENTIFRICE DISPENSER

BACKGROUND OF THE INVENTION

1. Field of Endeavor

This application relates to self-contained, self-dispensing toothbrushes that have a piston to deliver dentifrice from within a cylinder to the bristles of the brush head.

2. Discussion of the Prior of Art

Many approaches to extend a well-rounded self-dispensing toothbrush have been attempted. U.S. Pat. No. 4,071,300 (Nichols and Anderson) 1976, features a core method that allows placement of dentifrice to the centermost portion of the brush bristles, being of primary interest to the present invention.

U.S. Pat. No. 4,135,831 (Reitknecht) 1979, features a transmission-like planetary gear involving the turn dial, though functional, it is a complex approach which may best be served by simpler and more practical means.

U.S. Pat. No. 4,957,125 (Merle L. Yaneza) 1990, features a fully contained and compact style of toothbrush with dentifrice contained in a refillable cylinder, including a floss dispensary. The brush head removable, yet is not channeled for true self-dispensing of dentifrice to the brush head, from within. The consumer must have a third hand or table the brush head to dispense dentifrice thereupon.

U.S. Pat. No. 5,736,532 (Mergill and Mergill) 1998, features a self-dispensing toothbrush in which the brush head is connected to the cylinder by way of a central connective means, wherein the occurrence of wear resulting from repeated detachment may cause the brush head to become unstable even by its own connective end.

U.S. Pat. No. 5,842,487 (Ledet) 1998, incorporates a hopper to hold water or mouthwash. Though lidded, occurrences which cause spilling or leakage may occur.

U.S. Pat. No. 5,908,257 1999, features a brush head with multiple dentrifrice outlets from the brush plate which by virtue of numerous dispensary holes in the plate, reduces strength of the brush head regardless of the composite.

U.S. Pat. No. 6,957,925 (Jacobs and McDonald) 2005, features a highly engineered DC powered self-dispensing and oscillating toothbrush wherein two motors are utilized. Due to the nature of the '925 patent, a power source is required and workability is inter-dependant upon the lasting function of each electric device incorporated.

OBJECTS OF THE INVENTION

These referenced toothbrushes fall short in part for a variety of reasons ranging from awkward design and method, under or over engineering or even outright contraptionalization of the art—as in attempting to incorporate every aspect of the oral hygiene process into one apparatus. As a result, industry is not easily convinced to manufacture or standardize the such. As a further result, the consumer cannot utilize that which has no commonplace or is unavailable, altogether.

Therefore, it is the objective of this present invention to provide an improved design for a self dispensing toothbrush.

SUMMARY OF THE INVENTION

The present invention is a self-contained and self-dispensing toothbrush comprised of a cylinder unit conversely threaded at the upper most end and a brush head unit inversely threaded, such that both units may be securely mated to each other, forming the entire model. Both units are threaded and may be affixed one to another from either unit end, as such.

In addition, the device has a one piece multifunctional dial, self-contained, that is properly fitted and secured to the lower most end of the cylinder unit. The dial has a seating rivet to securely anchor to the cylinder unit and a threaded feed rod of given length. The solid core feed rod is threaded that it may actuate a piston, located and firmly fit within the cylinder, to move away from the lower most end of the chamber toward the upper most portion of the chamber, when the dial is turned clockwise.

The extending features of the piston include vertical grooves around the primary base of the piston that conjunct with the cylinder splines, to prevent the piston from freely turning within the cylinder. A piston head of sufficient length and a beveled crown delivers all remaining dentifrice, from the upper most end of the chamber, into the brush head unit. Also, pressure relief grooves are located within the neck and primary base of the piston to prevent hydro lock once the piston neck enters into the cylinder neck.

Basic operation of the present invention is as follows: With the cylinder and brush head units securely mated to each other, the dial is turned. The solid core threaded feed rod enables the piston to move in the forward (or upward) position. In doing so, the supplied dentifrice is forced out of the supply chamber, into the brush head channel.

Once at the end of the brush head channel, the dentifrice is forced through the exiting bore between a series of flatly arranged bristles, seated in such degree as to provide coverage over the exiting bore and any dentifrice waiting to be used. As the dentifrice is forced between the bristles, the arranged bristles expand toward a vertical position acting as a guide to direct the moving dentifrice over the top surface of the brush head bristles.

BRIEF DESCRIPTION OF THE DRAWINGS

FIG. 6. is a front view and an overhead view of the piston.

FIG. 8.B. is a transparency side view of the brush head unit, clarifying bristle anchorage.

FIG. 9.B. is a transparency front view of the brush head unit, clarifying bristle plot locations, including exampled expansion bristle formation.

FIG. 10.A. is a front view of a brush head unit depicting an X-formation of expansion bristles.

FIG. 10.B. is a front view of a brush head unit depicting an Ankh formation of expansion bristles.

FIG. 10.C. is a front view of a brush head unit depicting a triangle formation of expansion bristles.

FIG. 10.D. is a front view of a brush head unit depicting a curtain formation of expansion bristles.

FIG. 10.E. is a front view of a brush head unit depicting a vertical formation of expansion bristles.

FIG. 10.F. is a front view of a brush head unit depicting a vertical, bundled bristle formation of expansion bristles.

FIG. 10.G. is a front view of a brush head unit depicting an angled, bundled bristle formation of expansion bristles.

FIG. 12.B. is a front view of FIG. 12.A., a cylinder without associated parts, taken along the lines 12.B.-12.B.

FIG. 12.C. is a right side view of a cylinder with loosely associated parts.

FIG. 12.D. is a top view of the lock plate with associated features.

FIG. 12.E. is a left side view of the lock plate.

FIG. 12.F. is a right side view of a cylinder with parts fully installed.

FIG. 12.G. is a top sectional view of FIG. 12. F., a cylinder with associated parts, taken along the lines of 12.G.-12.G.

FIG. 14. B. is a front view of the primary cap.

FIG. 14. C. is a front view of the adaptor.

REFERENCE NUMBERS AND LISTINGS

Figure 1:
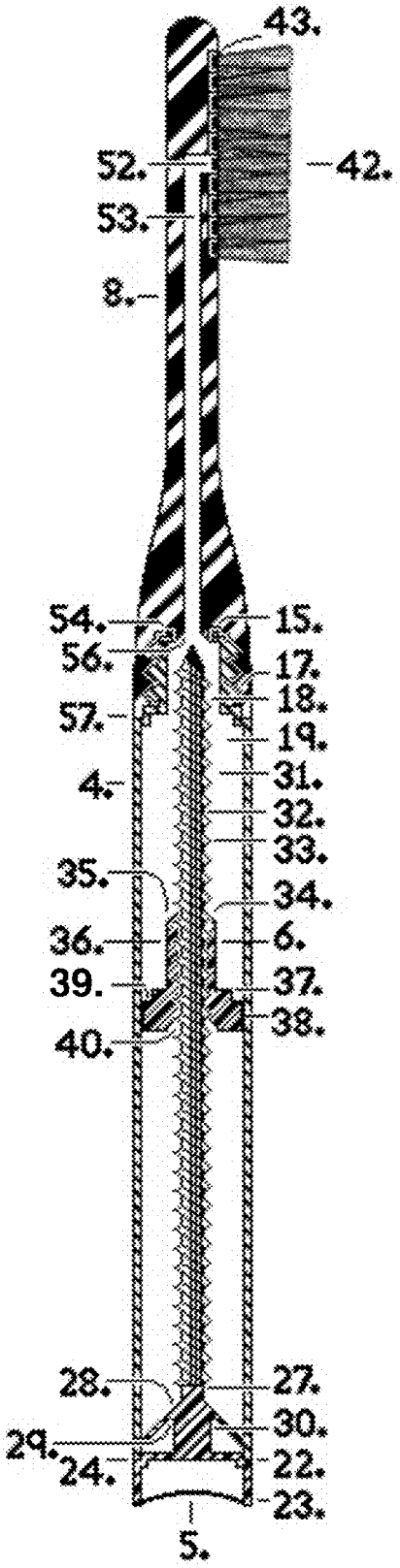
FIG. 1. is a side view, cross section of the preferred embodiment of the invention.

Numbers and Reference given to the features of the Sheets of Drawings contained therein are as follows:

1. The preferred embodiment of the present invention.
2. One embodiment of the invention.
3. A solid view of the invention.
4. Cylinder, empty, of the preferred invention.
5. Multifunctional Dial Assembly (or M.D.A.).
6. Piston.
7. Cylinder, containing all mechanisms, of the preferred invention.
8. Brush head unit, profile.
9. View of the face of the brush head unit.
10. Brush head and various formations of the expansion bristles.
11. An exploded diagram of the preferred invention.
12. A parts-in-focus layout of a cylinder, modified for refill, of one embodiment of the invention.
13. Cylinder depicting stages of refill.
14. Seal cap, primary cap, and adaptor.
15. Upper rim of cylinder.
16. Orifice of cylinder.
17. Threads of the cylinder.
18. Neck of the cylinder.
19. Primary chamber of the cylinder.
20. Connective bore.
21. Seating plane of the connective bore.
22. Lower rim of the cylinder.
23. Dial.
24. Seating rim of the dial.
25. Splines of the dial.
26. Rivet.
27. Rivet head.
28. Rivet face.
29. Seating plane of the rivet.
30. Rivet Shank.
31. Rod.
32. Core of rod.
33. Threads of rod.
34. Crown of piston.
35. Pressure relief groove A.
36. Neck of piston.
37. Pressure relief groove B.
38. Primary base of piston.
39. Grooves of primary base.
40. Seating formation of the piston.
41. Threaded bore of the piston.
42. Bristles of the brush head.
43. Anchor of the bristles.
44. Not used.
45. Expansion bristles in X formation.
46. Expansion bristles in ankh formation.
47. Expansion bristles in triangle formation.
48. Expansion bristles in curtain formation.
49. Expansion bristles in vertical formation.
50. Bundled bristles in vertical formation.
51. Bundled bristles in angular setting substituting for expansion bristles.
52. Tap channel.
53. Primary channel.
54. Milled groove.
55. Inverse threads
56. Lower extension of the primary channel
57. Seating rim of the brush head.
58. Slot of the refillable cylinder.
59. Upper guide plate.
60. Lower guide plate.
61. Stopper form.
62. Lock Plate.
63. Open Yoke.
64. Seating radian.
65. Flex groove.
66. Keeper tab.
67. Lock tab.
68. Push-pull tab.
69. Shank extension of the rivet relating to the refillable cylinder.
70. Seal cap.
71. Tab and grips of the seal plug.
72. Over plate of the seal plug.
73. Plug of the seal plug.
74. Adaptor relating to the refillable cylinder.
75. Quasi formation of adaptor, as means to "other" orifice.
76. Upper primary channel of adaptor.
77. Lower extension of the primary channel of adaptor.
78. Milled groove of adaptor.
79. Inverse threads.
80. Seating rim of the adaptor.
81. Primary cap.
82. Dentrifrice.
83. Brush cover

DETAILED DESCRIPTION OF THE INVENTION

The advantages of the present invention are:

1. A single device unifying what normally would take two separate products to accomplish.

2. The present invention is manufactured with the least amount of parts served by integration of key components. One form of the invention pays respect to material resource by means the cylinder is refillable, thus reusable and not readily disposable.

3. The piston sets at its lowest possible base point, maximizing the most area possible within the chamber to accommodate a maximum dentifrice supply.

4. The piston has an extended head, smaller in diameter than its base so that it may reach the top most exiting point of the cylinder, thereby evacuating the maximum percentage of supplied dentifrice contained within the chamber, reducing the acceptable limit of dentifrice loss after the cylinder is spent.

5. The piston head crown is such that it mates perfectly to the form of the lower extended channel of the brush head unit. This actually delivers the final amount of dentifrice into the brush head channel, itself, also reducing the possibility of mess during detachment of the spent cylinder.

6. The attached threaded rod is of such length as to actualize the piston into the upper most portion of the chamber that it may accomplish statements 4 and 5.

7. The cylinder length and diameter is generous enough, to not only house core function and dentifrice supply but also provides good handling during consumer use. The total area given on the exterior of the cylinder retains enough surface to accommodate applied grips of usable and decorative fashion as manufacture desires.

8. The dial, located at the bottom portion of the present invention, does not require the touching of hands or fingers to any area of the brush head portion of the invention—the portion which is inserted into the mouth, until cylinder change out.

9. The unit is self sealing, which does not allow the escape of dentifrice. However, a thin film of sealant, solidified after cure, may be applied to the inlayed groove surrounding the lower channel extension of the brush head unit if needed.

10. The brush head possesses only one large channel tap, centered on the brush plate thereby maintaining the strength value of the brush plate.

11. The set of flatly arranged expansion bristles, around the channel tap serve a triple purpose: a. For the brushing of teeth. b. To help prevent foreign bodies (food particulates, etc), from entering the tap channel. c. To act as a guide and to direct dentifrice upon the top of the brush bristles when flexing from pressure from the dentifrice, itself; as these bristles in their setting are the softest above any of the bristles.

12. The present invention is such that it can be can be accessorized in a quantity of ways, malleable to the individual life-styles of many people.

13. The present invention is compact. It is suitable within a wide range if temperature variations. It is good for home, travel, work, school and recreational uses of every conceptual environment a toothbrush has traversed, furthering to the plane of space.

14. The present invention is durable. The material of the brush head exists of modern, hard-to-destroy plastics, of current formulation, known to the art. The cylinder of the present invention is equally durable. The connective durability of the two units is outstanding with regard to many other make and models, drawn to art.

In another form of the invention, the cylinder unit, once exhausted of dentifrice, is refillable. A sliding lock plate, containing an open yoke, slides between the seating plane of the connective bore and the seating plane of the rivet portion of the multifunctional dial. The connective bore is expanded, that the rivet may no longer have any seating value to that portion of the bore and the shank of the rivet is additionally elevated with respect to the thickness of the lock plate. Length of the threaded rod is also accounted for. Guide plates, above and below, left and right about the four corners of the window slot, center the lock plate and guide its line-of-travel to the rivet shank. Once the narrowest point of the open yoke meets the shank, reasonable pressure is applied to the push-pull tab portion of the lock plate to snap fit the seating radian around the circumference of the rivet shank.

In the preferred embodiment illustrated in FIG. 1, with guidance to the drawings and referenced characters, there is shown a dynamic toothbrush 1. Toothbrush 1 includes a brush head unit 8. Brush bristles 42 extend from the face portion of brush head unit 8, while the bottom portion of brush head unit 8 is firmly mated by inverse threads 55, by clockwise rotational means, to converse threads 17 of cylinder 4.

The Multifunctional Dial Assembly 5 is firmly seated to the lower portion of cylinder by rivet means 26 to the seating portion of the connective bore 20 of cylinder 4. Rod 31, having threads 33 about its circumference, is threaded with right hand threads and is fused to the top of the rivet head 27. The threaded rod 31 is diametrically centered within the primary chamber 19 of cylinder 4. The threaded rod 31 is specifically centered to meet pistons' 6 threaded bore 41. Threaded bore 41 of the piston 6 is inversely threaded with left hand threads.

Piston 6 firmly fits within the walls of primary chamber 19 of the cylinder 4 so that a clockwise rotation of dial 23 enables piston 6 to move within the primary chamber 19, along the axis of threaded rod 31 toward the brush head 8. Dentifrice 82 is forced through the primary channel 19 of brush head 8 to the tap channel 52, then between the expansion bristles 45 and directed to the top most portion of the bristles 42.

In operation, the user holds cylinder 4 stationary while rotating the dial 23 in a clockwise fashion. Piston 6 moves toward the brush head unit 8, which is securely mated to the cylinder 4 by threaded connective means 17 and 55. Equally, dentifrice 82 is forced through the primary channel 53 of brush head 8 to tap the channel 52, then between expansion bristles 45 and directed to the top most surface of the bristles 42.

When dentifrice 82 volume is exhausted, the consumer detaches the spent cylinder 4, containing associated parts, keeping only the brush head unit 8 and attaches a newly charged cylinder 4, containing fresh dentifrice 82.

Figure 2:
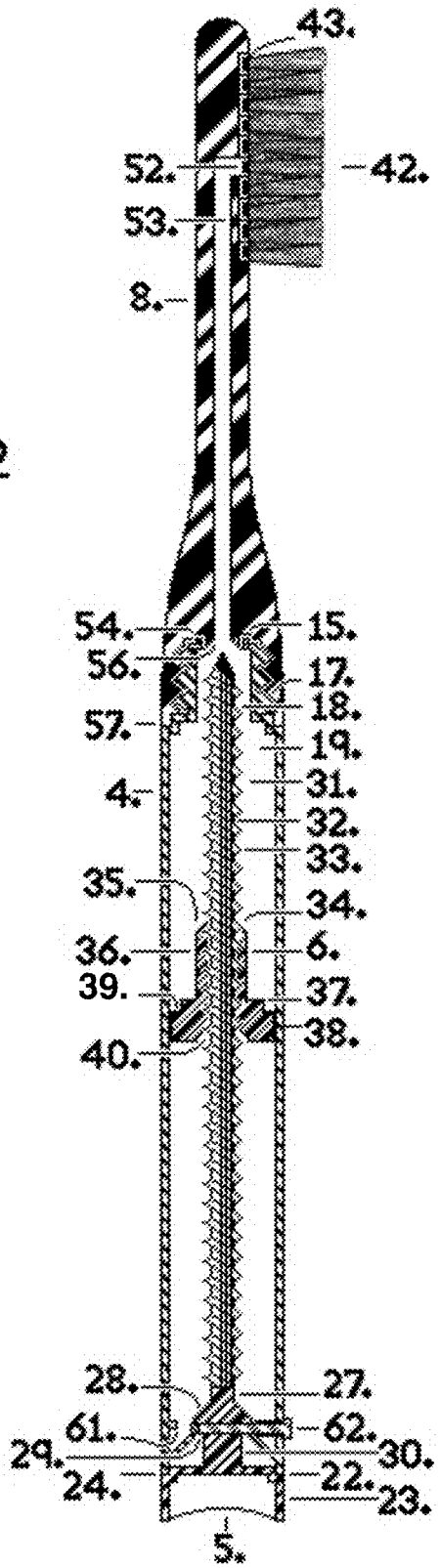
FIG. 2. is a side view, cross section of one embodiment of the invention further describing a refillable cylinder and the sum of parts and mechanisms embodied.
Figure 3:
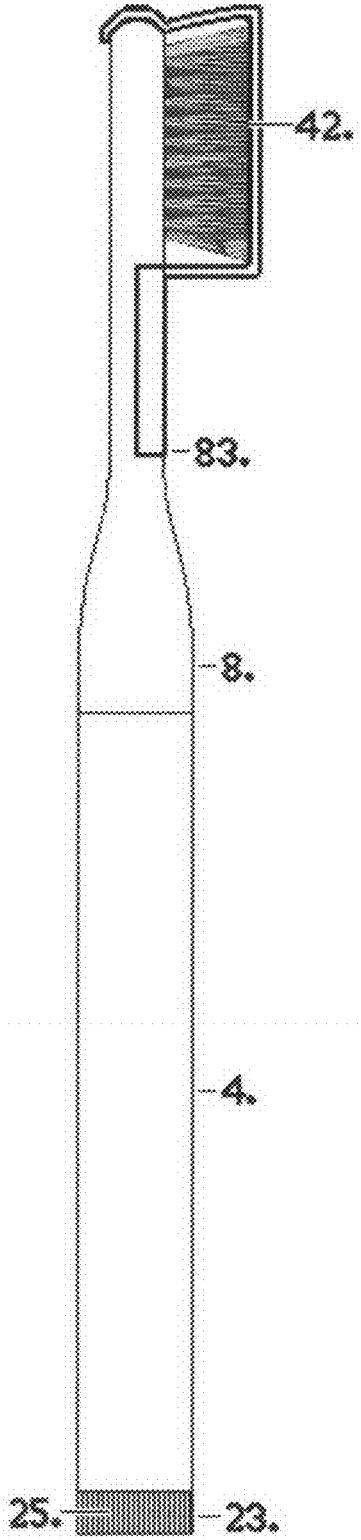
FIG. 3. is a view of the exterior of the invention.
Figure 4:
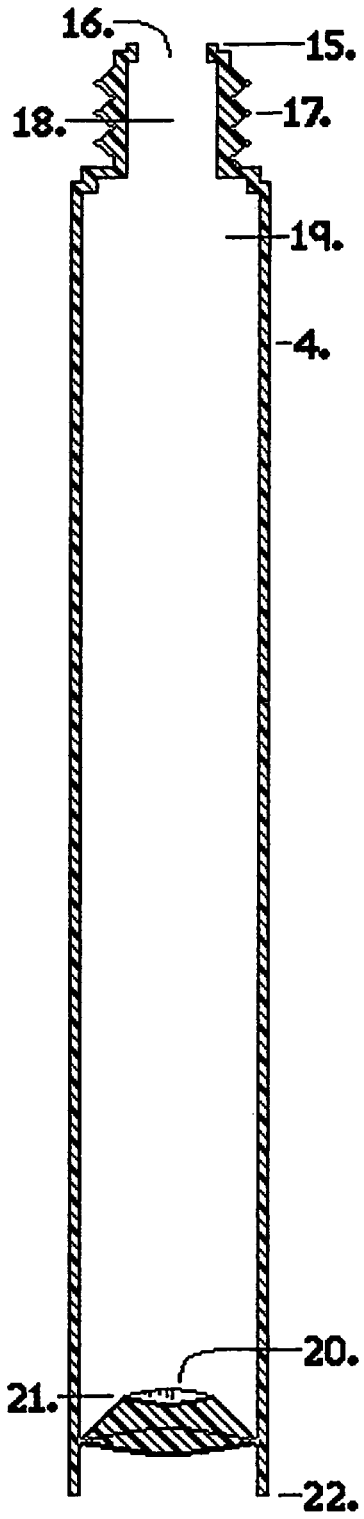
FIG. 4. is a front view of a freestanding cylinder, without associated parts.
Figure 5:
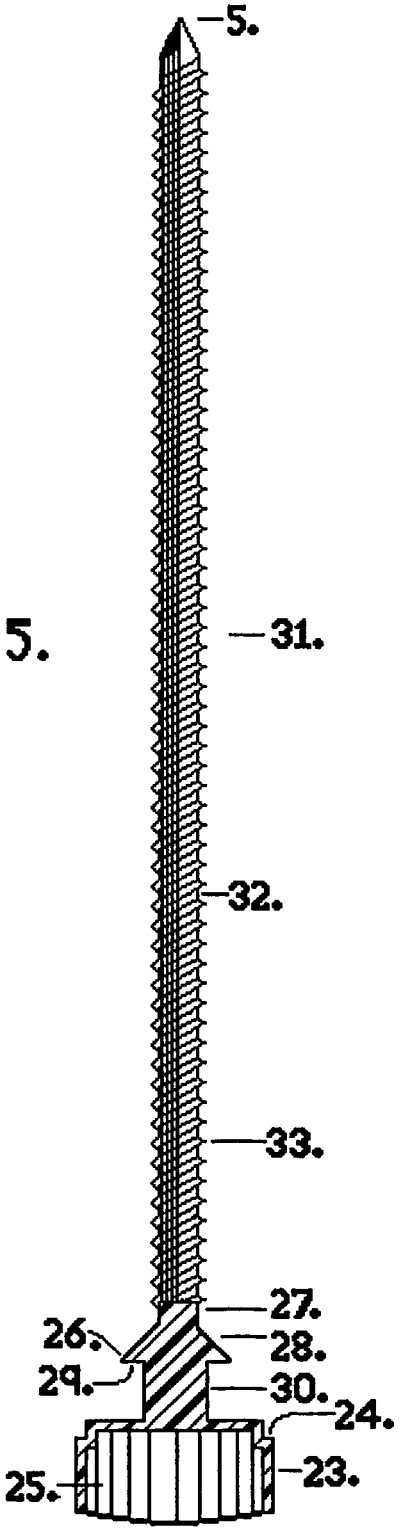
FIG. 5. is a front view of the multifunctional dial, showing the seating rivet and a view of the threaded rod.
Figure 7:
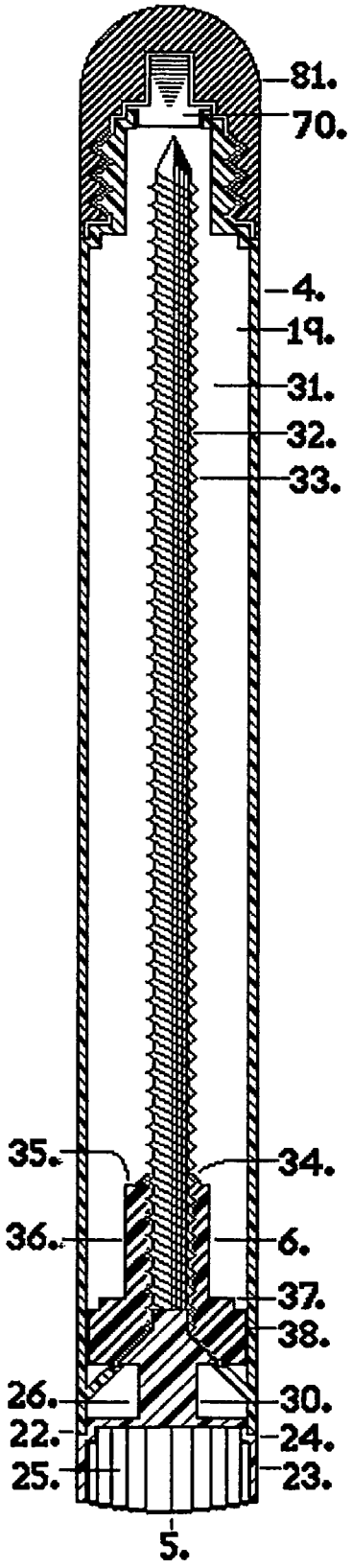
FIG. 7. is a front view, of a freestanding cylinder showing all parts installed.
Figure 8:
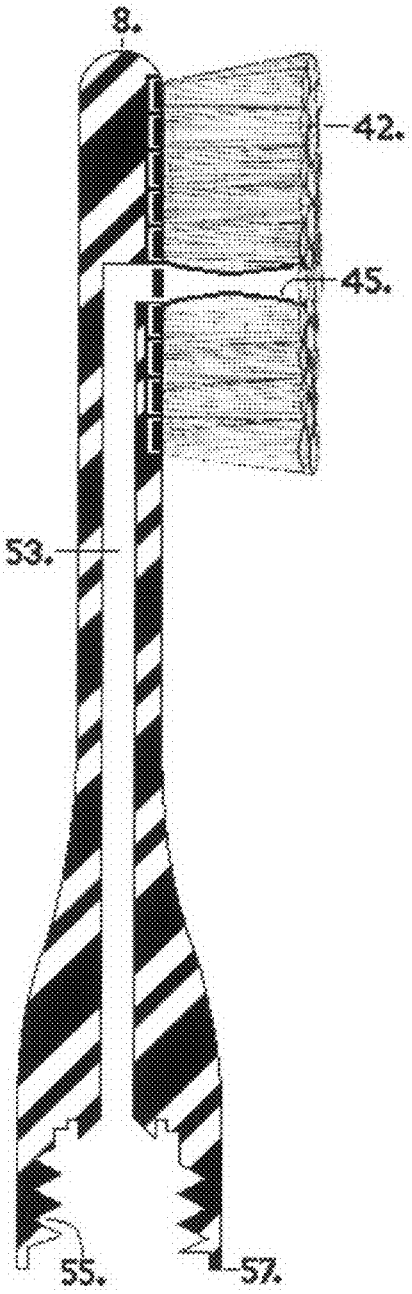
FIG. 8. is a side view of the brush head unit, cross-sectioned to highlight the primary channel.
Figure 8B:
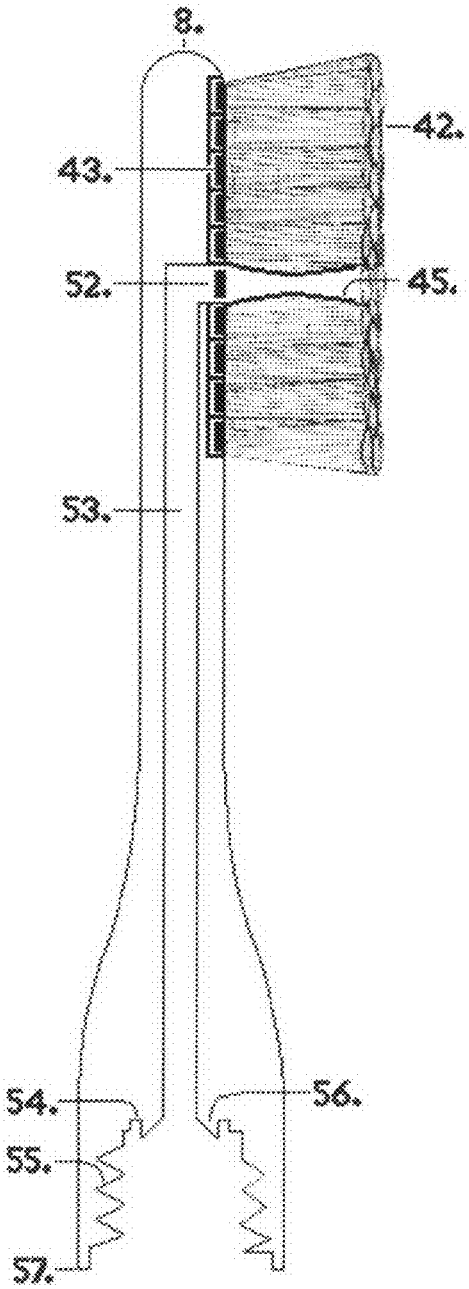
Figure 9:
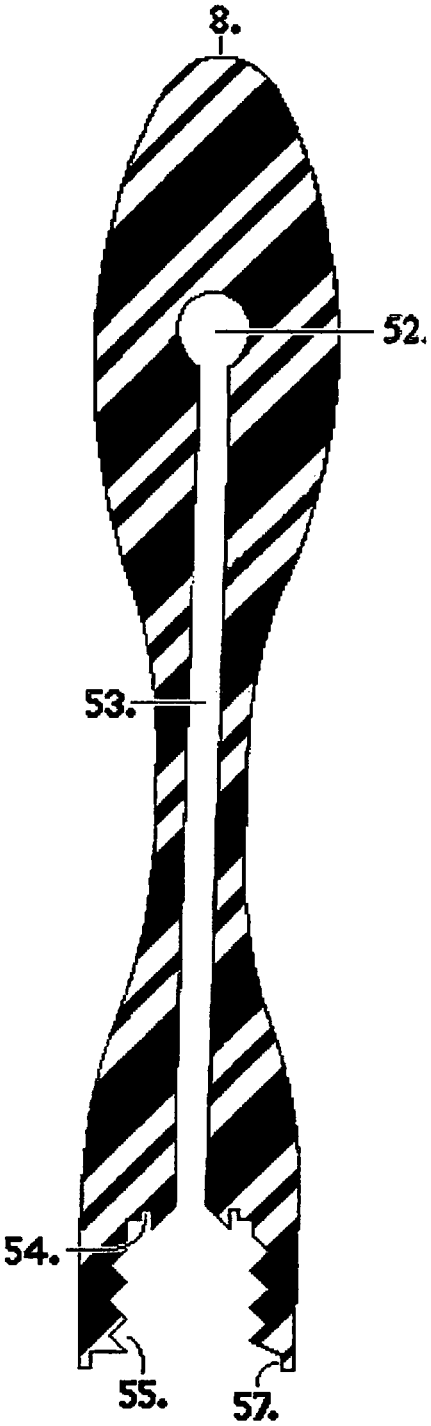
FIG. 9. is a front view of the brush head unit, cross-sectioned to highlight the tap channel.
Figure 9B:
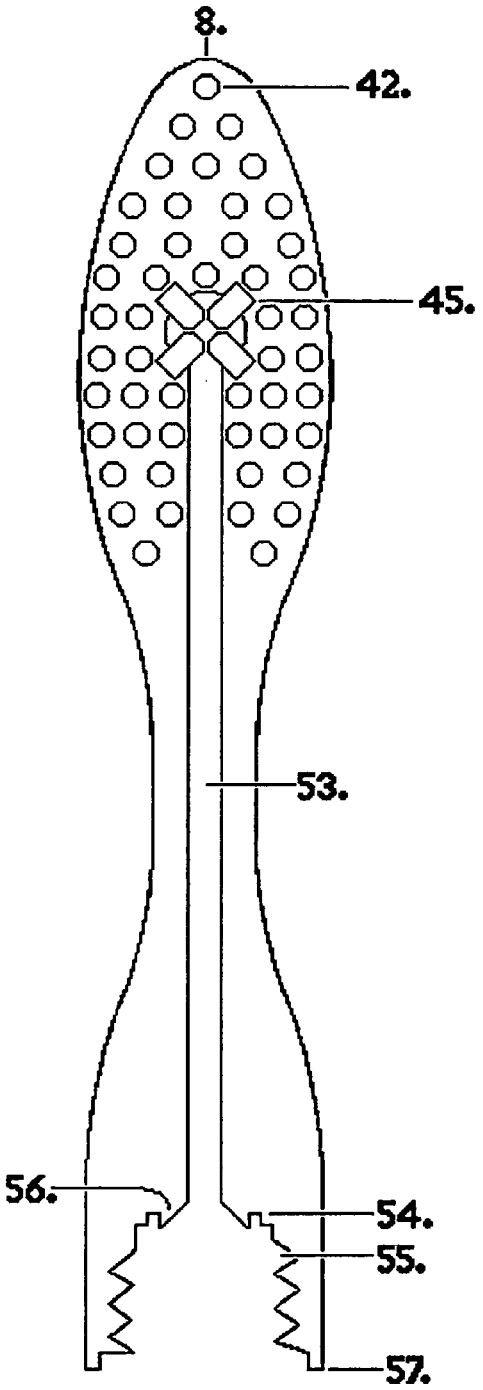
Figure 11:
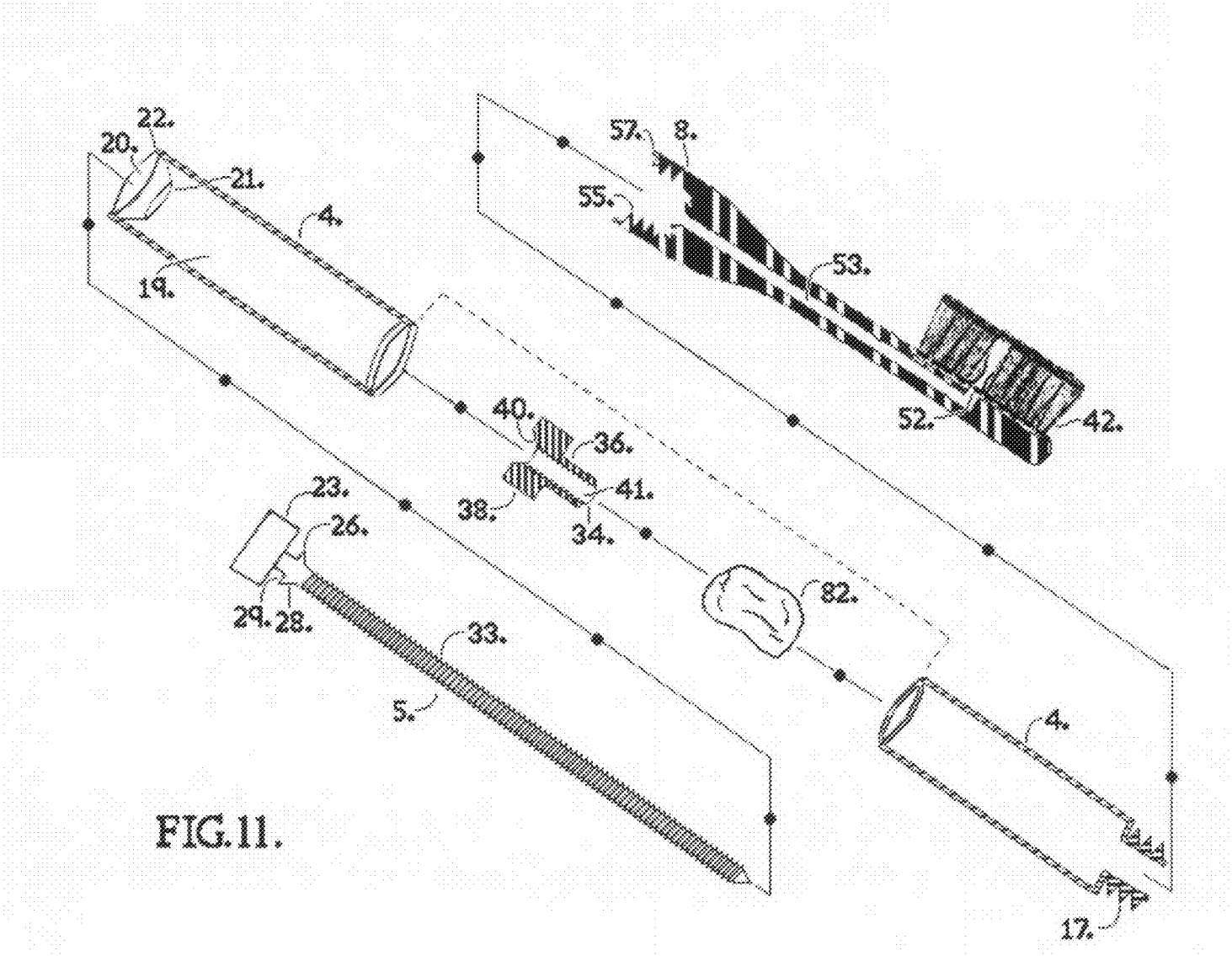
FIG. 11. is an exploded view of the invention.
Figure 12A:
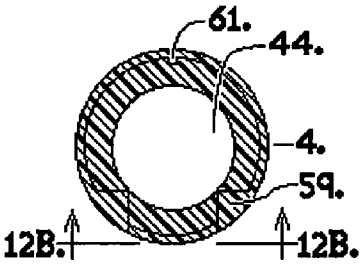
FIG. 12.A. is a top view of a cylinder without associated parts.
Figure 12B:
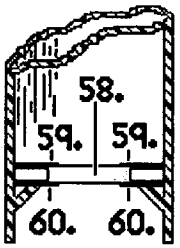
Figure 12D:
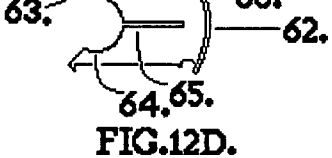
Figure 12E:
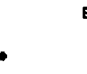
Figure 12C:
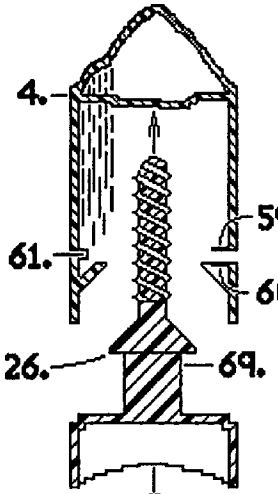
Figure 12F:
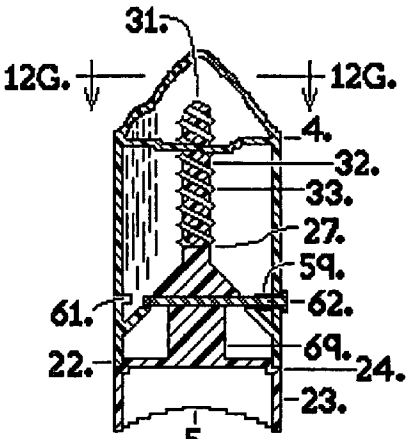
Figure 12G:
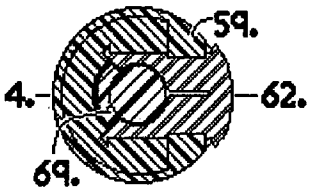
Figure 13A:
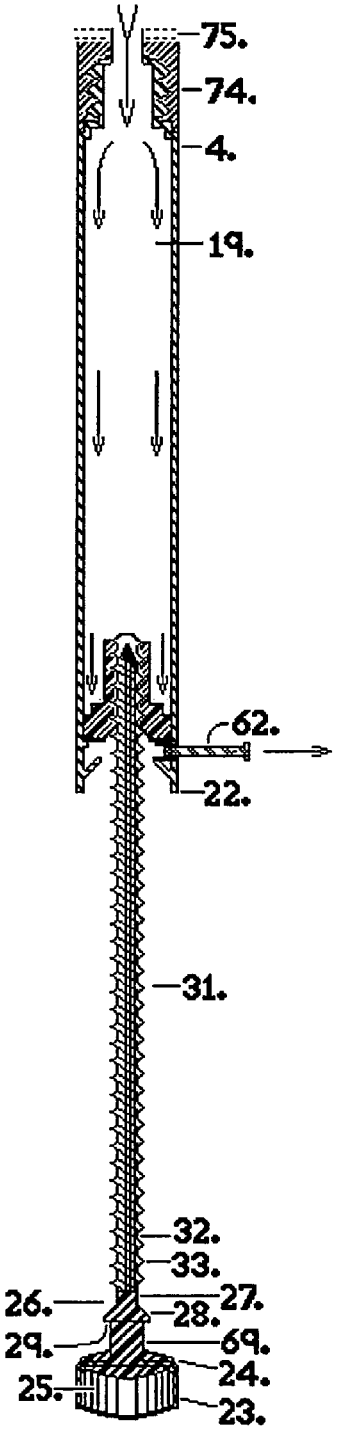
FIG. 13A. is a stage one view of a refillable cylinder, wherein the cylinder is in the filled position.
Figure 13B:
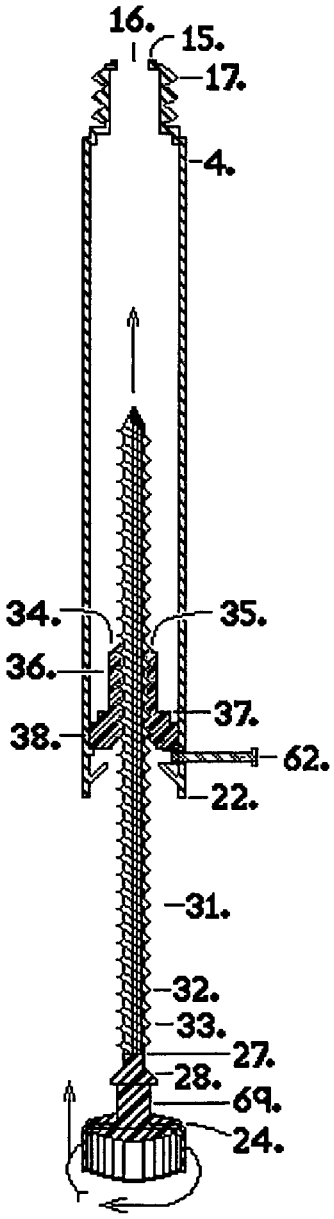
FIG. 13B. is a stage two view of a refillable cylinder, wherein the dial is rotated toward the seated position.
Figure 13C:
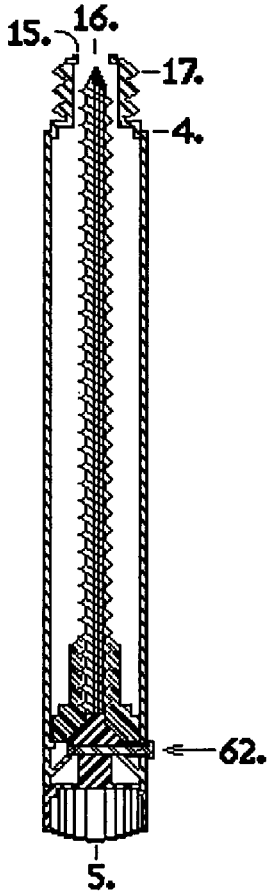
FIG. 13C. is a final stage view of a refillable cylinder, wherein the dial is in the seated position, the lock plate is secured, and the cylinder is ready for use.
Figure 14B:
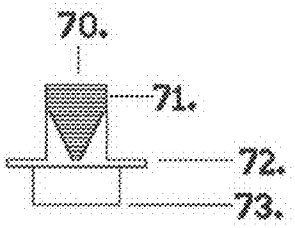
FIG. 14. A. is a front view of the seal cap.
Figure 14C:
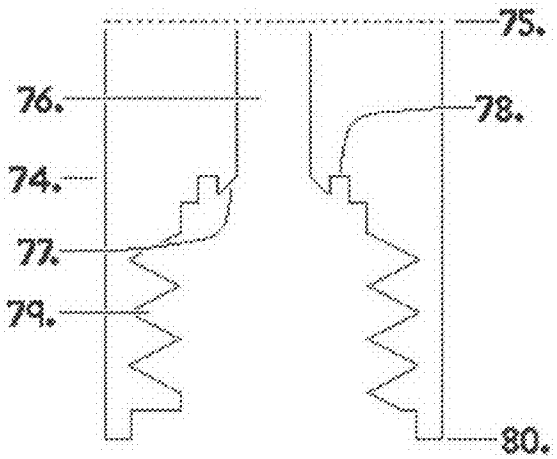
Figure 14A:
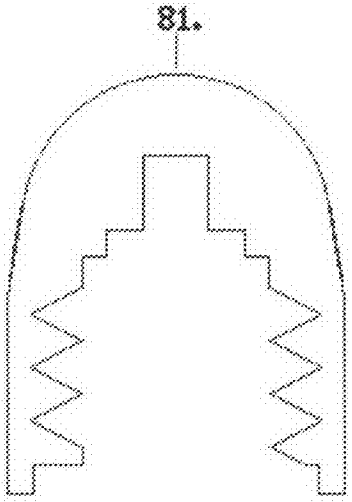

In one form of the invention, the embodiment illustrated in FIG. 2, all working features of the preferred invention FIG. 1, are available as described with extending features that allow cylinder 4 to be recharged from 'other' dentifrice supply.

The cylinder features a slot 58, notched through to the primary chamber 19. Upper guide plates 59 and lower guide plates 60 are located about the four corners of the slot 58, within primary chamber 19, to guide the lock plate 62 to or from the extended shank 69 of rivet 26 when push/pull tab 68 of lock plate 62 is pushed or pulled.

Connective bore 20 is widened to render seating plane 29 of rivet 26 to no seating value of that given surface. Seatability of rivet 26 is maintained upon the surface of lock plate 62 in which the lower surface of lock plate 62 rests upon the seating plane 21 of connective bore 20 of a wider diameter, when lock plate 62 is in the locked position. The locked position of lock plate 62 occurs when the narrowest point of the open yoke 63 has passed around the circumference of extended shank 69, of rivet 26, seating both shank 69 and the seating radian 64 of lock plate 62, together.

Flex groove 65 of the lock plate 62 allows flexibility when pressure to push/pull tab 68 is applied. Keeper tab 66 retains the lock plate 62 within the cylinder 4. Lock tab 67 is seated upon the inner wall of primary chamber 19 in timing of the seating radian 64, seated to the rivet shank 69.

Stopper formation 61 is triangularly located, opposing two upper guide plates 59 upon the inner wall of primary chamber 19. The top surface of the stopper formation 61 is level with the top surface of the upper guide plates 59 where the pistons' primary base 38 will seat upon, in the loaded or reloaded position.

In particular the refill process is as follows:

a. When the dentifrice is spent and the piston is rendered in the exhausted position, the cylinder and brush are detached from each other.
b. The lock plate of the refillable cylinder is pulled 'out' by the push-pull tab, freeing the seating portion of the rivet
c. The select adaptor means is attached to the new dentifrice supply.
d. The refillable cylinder is attached to the adaptor.
e. The other dentifrice supply is deposited into the refillable cylinder through the adaptive means. This causes the lower assembly (dial, rivet and rod) to eject out from the cylinders' lower end. The refillable cylinder is fully charged when the assembly is stopped by the seating formation of the piston halted by the stopper formation and surface of the upper guide plates.
f. The refillable cylinder and adaptive means are detached from each other.
g. The dial must be repeatedly turned counterclockwise a number of times to reseat the rim of the dial to the lower rim of the refillable cylinder.
h. Once the dial sets firm to the cylinder, the push-pull tab portion of the lock plate is pushed in, locking the assembly and rendering it ready for usage.
i. Refillable cylinder and brush are reattached to each other.
j. The device is now ready for use.

When dentifrice volume 82 of the cylinder 4 is spent and the piston 6 is rendered into the exhausted position, the user detaches cylinder 4 from the brush head 8 and pulls the push/pull tab 68 of lock plate 62 freeing the multifunctional dial assembly 5 from the open yoke 63 of lock plate 62. The user attaches select, quasi-adaptive means 75 of adaptor 74 to the new dentifrice 82 supply then attaches the connective means 17 of cylinder 4 to inverse threads 79 of the adaptor 74. The user firmly deposits dentifrice 82 from the new supply through both upper channel 76 and lower channel 77 of adaptor 74 to within neck 18 and primary channel 19 of cylinder 4, in doing so, piston 6 is forced backward toward the surface of stopper formation 61 and upper guide plates 59. The multifunctional dial assembly 5 is ejected from the connective bore 20 by reason that the threaded bore 41 of piston 6 maintains retention to the threaded rod 31. The user detaches cylinder 4 from adaptor 74 and must begin a series of counterclockwise turns of dial 23 to reseat the dial rim 24 firmly to the rim 22 of the cylinder 4 while not disturbing the loaded position of the piston 6. Once accomplished, the push/pull tab 68 of lock plate 62 is pressed into place, locking the seating radian 64 around the circumference of the extended shank 69 of rivet 6.

Recharge of cylinder 4 is complete.

These detailed steps expound a method of simplicity wherein the steps taken occur with moderate flow. When understood in practice, the undertaking in routine may be accomplished within a time frame of less than two minutes.

Either embodiment of the invention has related sealing means that is automatic. The lower channel extension 56 of the brush head 8 is tightly seated within the orifice 16 of the cylinder 4 allowing sealibility. The upper rim 15 of the cylinder threaded means 17 is elevated and surrounds the lower channel 56 of the brush head 8. Upper rim 15 of the cylinder 4 is tightly seated into the milled groove 54 of the brush head 8, also adding further sealibility. Sealing means between piston 6 and the wall of primary chamber 19 of cylinder 4 is accomplished by the edge of the pistons' primary base 38 in which the edge, primary base 38 and material of piston 6 thereof is suitable to serve mechanical function, raking and sealing means against high viscose dentifrice 82.

Pressure groove 35, vertically formed along the neck 36 of the piston 6, and pressure groove 37, formed laterally across the primary base 38 prevents hydro lock of the piston 6 when the piston neck 36 enters into the cylinder neck 18, also allowing the escape of dentifrice 82 by way of these passages to the crown 34 of piston 6.

Cylinder 4 is presented new with a seal cap 70 fitting and a primary cap 81.

Brush cover 83 provides a canopy over and around bristles 42 of the brush head 8. The brush cover 83 is held by the top edge of the brush head 8 in the groove formation of brush cover 83 and a snap-fitting to the narrowest mergence of the brush head unit 8.

Clearly, varied forms and means may be used or modified concerning the embodiment of this invention, to those skilled in the art. The spirit and scope of embodiments described, is given by way of the specification as a key example and is meant to shed light beyond the limit and terms, which the appended claims surround.

I claim:

1. A dynamic toothbrush with integral dentifrice dispenser comprising:

a) a replaceable cylinder, having an open top, and a bottom, an inner diameter, and an innermost lower end within said replaceable cylinder, the open top of said cylinder also having a shape having a stepped lower portion having a diameter, and an upper portion having a cylindrical form having a conical top portion wherein the cylindrical form having a narrower diameter that that of said stepped lower portion;

b) a replaceable brush head unit having a defined plurality of bristles, threadably attached to said cylinder, said plurality of bristles having at least one defined structure, said brush head having a channel in operable communication with a quantity of dentifrice placed in said cylinder;

c) a means for dispensing dentifrice installed in said cylinder, said means having a splined and grooved dial, a threaded feed rod, attached to said grooved dial and extending upwardly therefrom through said replaceable cylinder, and a piston having a shape having a stepped base having a diameter equal the inner diameter of said replaceable cylinder and an upper portion having a cylindrical body having a diameter smaller than that of said stepped base and a top having a conical form such that the shape of said piston conforming to the shape of the top of the replicable cylinder, said piston also having an open interior such that said threaded feed rod extends through said piston, and further wherein said piston is in operable communication with said quantity of dentifrice;

d) wherein said splined and grooved dial has a raised rim, which seats within the innermost lower end of said cylinder.

2. The toothbrush, as recited in claim 1, wherein the quantity of dentifrice is replaceable.

3. The toothbrush, as recited in claim 1, wherein said cylinder further comprises a connective bore, and a slot formed upon the outer surface of said cylinder, said slot being positioned above the connective bore.

4. The toothbrush as recited in claim 3, further comprising of a lock plate, slidably installed in said slot.

5. The toothbrush, as recited in claim 1, wherein the defined structure of said plurality of bristles is a defined pattern.

6. The toothbrush as recited in claim 1, wherein at least one defined structure of said plurality of bristles is selected from the group of expansion bristles in: X-formation, expansion bristles in curtain ankh formation, expansion bristles in triangular formation, expansion bristles in curtain formation, expansion bristles in vertical formation, bundled bristles in vertical formation, and bundled bristles in angular setting.

7. The toothbrush as recited in claim 1, wherein said toothbrush is disposable.

8. The toothbrush as recited in claim 5 wherein the defined pattern is selected from the group of expansion bristles in: X-formation, expansion bristles in ankh formation, expansion bristles in triangular formation, expansion bristles in curtain formation, expansion bristles in vertical formation, bundled bristles in vertical formation, and bundled bristles in angular setting.

9. The toothbrush as recited in claim 1 wherein the stepped base has as at least two horizontal grooves formed therein.

10. The toothbrush as recited in claim 1 wherein the upper portion of said piston has at least two vertical grooves formed therein.

* * * * *